United States Patent [19]

Rowan

[11] 4,424,082

[45] Jan. 3, 1984

[54] METHOD FOR CLEANING PARTS IN A TOTE BOX

[75] Inventor: Henry A. Rowan, Watchung, N.J.

[73] Assignee: Economics Laboratory, Inc., St. Paul, Minn.

[21] Appl. No.: 321,278

[22] Filed: Nov. 13, 1981

[51] Int. Cl.[3] ..... B08B 3/04

[52] U.S. Cl. ..... 134/25.4; 134/26; 134/62; 134/135; 134/150

[58] Field of Search ..... 134/25.3, 25.4, 26, 134/62, 72, 120, 135, 150, 157, 159

[56] References Cited

U.S. PATENT DOCUMENTS

| | | | |
|---|---|---|---|
| 386,256 | 8/1988 | McQuaide . | |
| 837,559 | 12/1906 | Graham | 134/150 |
| 2,028,267 | 1/1936 | Edhofer et al. | 134/7 |
| 2,726,642 | 9/1955 | Zinty et al. | 121/150 |
| 2,824,029 | 2/1958 | Zinty | 134/23 |
| 2,857,923 | 10/1958 | Zinty | 134/141 |
| 3,022,790 | 2/1962 | Carie | 134/465 |
| 3,047,436 | 7/1962 | Zinty | 134/23 |
| 3,083,716 | 4/1963 | Rowan et al. | 134/46 |
| 3,269,571 | 8/1966 | McLearn et al. | 214/302 |
| 3,384,097 | 5/1968 | Meeker et al. | 134/46 |
| 3,468,320 | 9/1969 | Cumming | 134/46 |
| 3,578,002 | 5/1971 | Rowan et al. | 134/25 R |
| 3,608,568 | 9/1971 | Hallsworth | 134/150 X |
| 3,615,824 | 10/1971 | Hittel et al. | 134/25.4 |
| 3,633,594 | 1/1972 | Boundy | 134/150 X |
| 3,979,220 | 9/1976 | Ishiyama et al. | 134/10 |
| 4,174,722 | 11/1979 | Fleenor et al. | 134/62 |
| 4,240,453 | 12/1980 | Vial et al. | 134/107 |

FOREIGN PATENT DOCUMENTS

| | | |
|---|---|---|
| 1097698 | 1/1968 | United Kingdom . |

*Primary Examiner*—Marc L. Caroff

*Attorney, Agent, or Firm*—Merchant & Gould

[57] ABSTRACT

The contents of an open-top tote box are cleaned by flooding the tote box while the tote box is horizontal at a first position with a volume of cleaning solution at least twice that of the tote box so that the solution flows over the open top of the tote box; indexing the tote box to a second position where the flooding operation is repeated; indexing the tote box to a third position where an apertured cover is placed over its open top and then rotating the tote box less than 180° to remove cleaning solution from the tote box through the cover.

4 Claims, 8 Drawing Figures

METHOD FOR CLEANING PARTS IN A TOTE BOX

BACKGROUND OF THE INVENTION

1. Field of the Invention

This invention relates generally to a washing apparatus and more specifically to an apparatus and method for washing small parts, such as bearings, screws, machine parts, nuts, bolts, etc., and the containers utilized in handling the small parts. In the manufacture and handling of such small parts the pieces are usually carried in tote boxes. These tote boxes are typically watertight. Prior to use, storage or shipping, the small parts must be cleaned, treated to prevent rust or storage deterioration or prepared for further processing such as painting, plating, or further machining.

2. Description of the Prior Art

In prior art systems for cleaning small parts, the tote box contents are typically emptied into washing machines of varied configurations. The tote box and contents are cleaned separately, after which the parts are returned into the same or different tote boxes. Such systems generally require manual materials handling steps, which increase the time and cost of a cleaning operation.

With systems wherein the contents and tote box are cleaned separately, there is a possibility that parts from one tote box may become mixed with parts from another tote box. Such a mixture of different type parts is highly undesirable. For example, dissimilar parts may not fit into a jig fixture or die designed for other parts in the container. A parts mix, therefore, can be potentially damaging to processing equipment and can create a hazard to an equipment operator.

An example of one prior art apparatus which solves some of the above problems is disclosed in U.S. Pat. No. 3,578,002, which is assigned to the assignee of the present application. This apparatus dumps the tote box contents into a container, cleans both contents and tote box, and then returns the contents to the same tote box. The container includes a plurality of perforated cages arranged in ferris wheel fashion about a shaft. The cages are rotated about the shaft causing the contents of a tote box to empty into the perforated cage. The small parts descend to the lower part of the perforated cage, and the cage rotates into a cleaning solution bath. During rotation, the tote box is also submerged in the cleaning solution bath which simultaneously cleans both the tote box and the tote box contents. As the rotation continues, the contents are lifted from the cleansing bath and are returned to the same tote box. While this apparatus solves many of the problems associated with the early washing apparatus, the entire ferris wheel assembly must be raised or lowered into the washing tank, making this process relatively slow. Further, the ferris wheel apparatus does not lend itself readily to multistage cleaning operations and depends upon a soaking action to clean the parts. Also, since the small parts tend to bunch together in the container, some of the surfaces may not be exposed to the cleansing bath, resulting in incomplete cleansing thereof.

In other prior art systems for cleaning small parts, the tote box contents and the tote box are cleaned together. There are several automatic washing machines which clamp lids onto the tote boxes and then rotate them either in a spray chamber or immerse them in a dip tank. The lids have a number of perforations smaller than the parts to be washed. The lids are not flat. They have side walls cooperatively connected to a perforated floor member. Therefore, when the tote box is rotated, the cleaning fluid is dumped from the tote box, and the contents are dumped for the tote box into the cover. Then, when the tote box is rotated to its upright position, the contents are dumped back into the tote box.

The disadvantage found in the automatic unit is generally that the rotating mechanism and the lid arrangement needed to turn the tote box and parts over becomes complicated and is very prone to damage or parts spill, if the tote box comes to the machine in a damaged or bent manner. When the tote box is damaged or bent, the contents tend to spill as the contents are dumped from the cover back into the tote box.

The present invention eliminates the disadvantages of the prior art small parts cleaning systems. The present invention provides an apparatus and method for quickly, efficiently, and automatically cleaning together both the tote box and contents.

SUMMARY OF THE INVENTION

The present invention relates to a method and apparatus for cleaning the contents of an open top tote box. The apparatus includes a cover having apertures smaller than the contents of the tote box. Means for engaging the cover to the open top of the tote box is provided.

The apparatus also includes means for supplying the tote box with a cleaning solution. In a preferred embodiment, piping supplies a volume of cleaning solution that is greater than twice to the volume of the tote box, before the tote box is indexed to the next station.

Means for rotating the tote box between first and second positions after the tote box has been flooded is provided. After the cover is engaged to the open top of the tote box in a first position, the tote box is rotated to a second position and any solution in the tote box is emptied through the cover. The contents of the tote box is retained in the tote box by the cover.

The apparatus also includes means for transporting the tote box through one or more cleaning or treating stages. Each stage may have one or more stations.

In a preferred embodiment, the apparatus further includes an initial draining stage having means for engaging the cover to the open top of the tote box and means for rotating the tote box between first and second positions. After the cover is engaged to the open top of the tote box and the first position, the tote box is rotated to the first position and any fluids in the tote box are emptied through the cover. The contents of the tote box is retained in the tote box by the cover. The initial draining stage includes a reservoir for receiving the cutting fluids emptied from rotating the tote box and means for transporting the tote box to a first cleaning station.

In a preferred embodiment, the flooding means includes means for supplying a washing solution to a first cleaning stage and means for supplying a rinsing solution to a second cleaning stage.

DETAILED DESCRIPTION OF A PREFERRED EMBODIMENT

Figure 1:
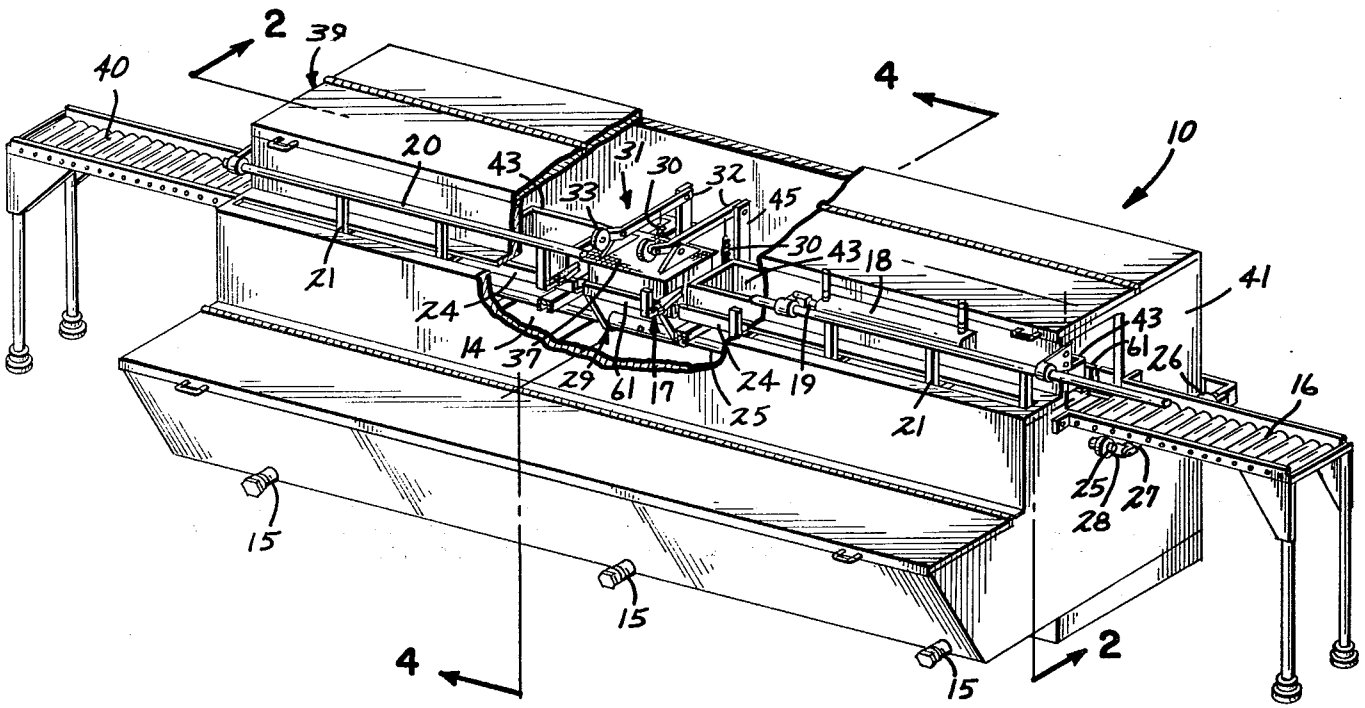
FIG. 1 is a view in perspective of the apparatus embodying the present invention with a portion thereof broken away.

In FIG. 1, there is generally designated as 10, a tote box parts washer. The base of the tote box parts washer 10 includes an oil tank reservoir 11, wash tank reservoir 12 and rinse tank reservoir 13. Each reservoir 11, 12, and 13 has a drain 15. A tunnel section, generally designated as 39, is positioned above the reservoirs 11, 12, and 13. The bottom of the tunnel section 39 is open to the top of the reservoirs 11, 12, and 13.

Loading conveyors 16 is positioned adjacent to the side wall 41 of the tunnel section 39. Unloading conveyor 40 is positioned adjacent to the side wall 42 of the tunnel section 39. Tote box 43 arrives at the tote box part washer 10 on the loading conveyor 16. The tote box 43 may be fed into the tote box part washer 10 either manually or by a standard stop-batch and feed mechanism (not shown).

Figure 2:
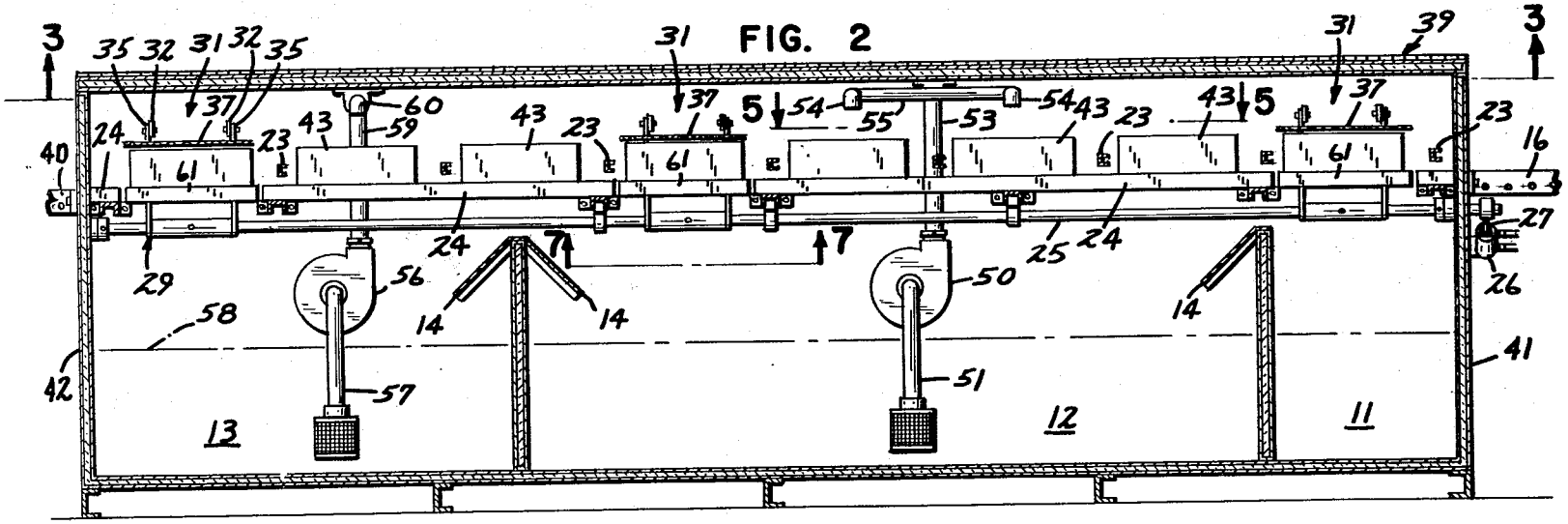
FIG. 2 is a cross-sectional view of the present invention as shown in FIG. 1, taken generally along the lines 2—2.
Figure 4:
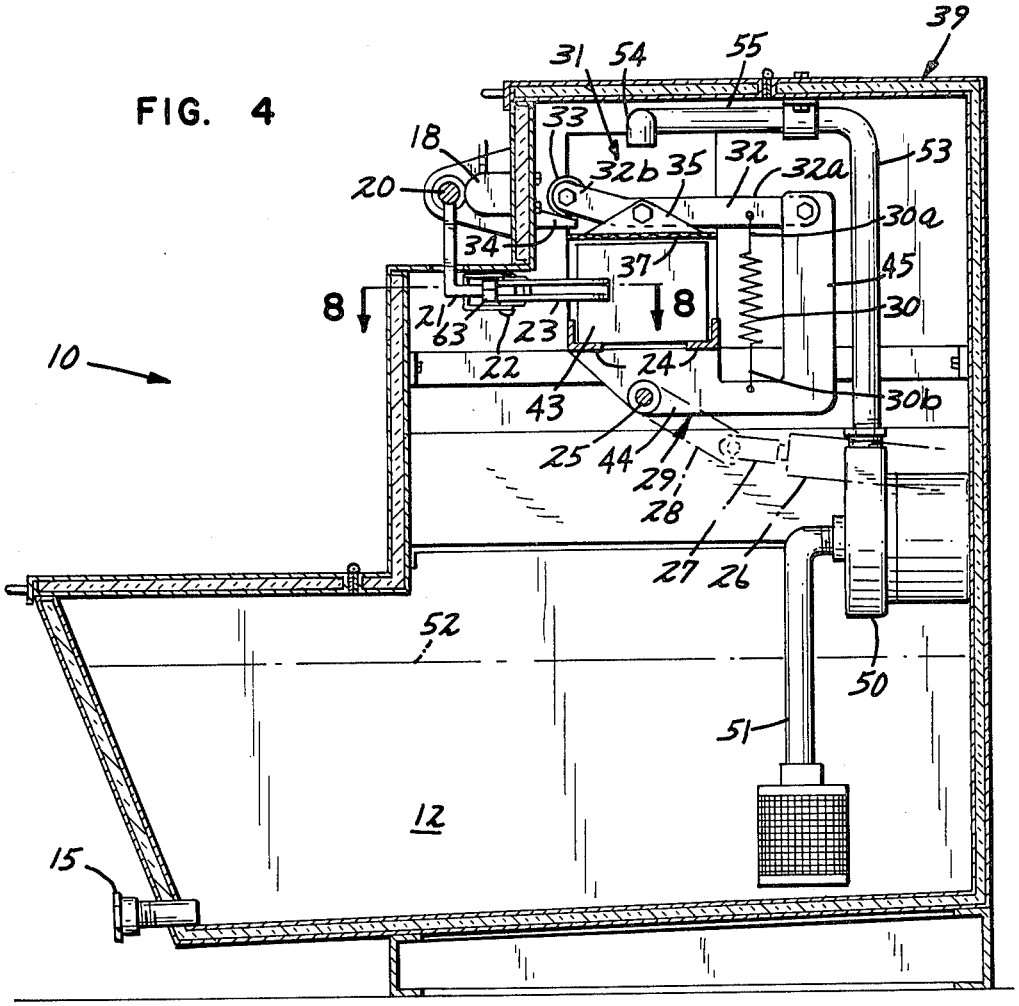
FIG. 4 is a cross-sectional view of the present invention as shown in FIG. 1, taken generally along the lines 4—4.

As shown in FIG. 2, positioned above each reservoir 11, 12, and 13 is a cover engaging mechanism, designated generally as 31. As shown in FIG. 4, the cover engaging mechanism 31 includes a pivotally mounted tote box support member 29, having a first portion 44 keyed to a shaft 25, and upwardly extending second portion 45 connected to the first portion 44. The tote box support member 29 rotates between first and second positions. An elongate member 32 having a first end **32*a* and a second end 32*b* is pivotally connected at its first end 32*a* to the second portion 45 of the tote box support member 29. A roller 33 is attached to the second end 32*b* of the elongate member 32. The roller 33 rests on a supporting surface 34 when the tote box support member 29 is in the first position. A cover holding member 35 is cooperatively connected to the elongate member 32 and positioned above the first portion 44 of the tote box support member 29. A spring 30 has a first end 30*a* connected to the elongate member 32 and a second 30*b* connected to the tote box support member 29, biasing the cover holding member 35 toward the first portion 44 of the tote box support member 29. When in the first position, the supporting surface 34 holds the elongate member 32 and the cover holding member 35 above the open top of the tote box 43. As the tote box support member 29 is rotated, the roller 33 is removed from the supporting surface 34 and the spring 30 biases the cover holding member 35 against the open top of the tote box 43**. It is understood that other suitable cover engaging mechanisms could be used to effectively secure a flat screen cover to the top of an open top tote box.

Figure 7:
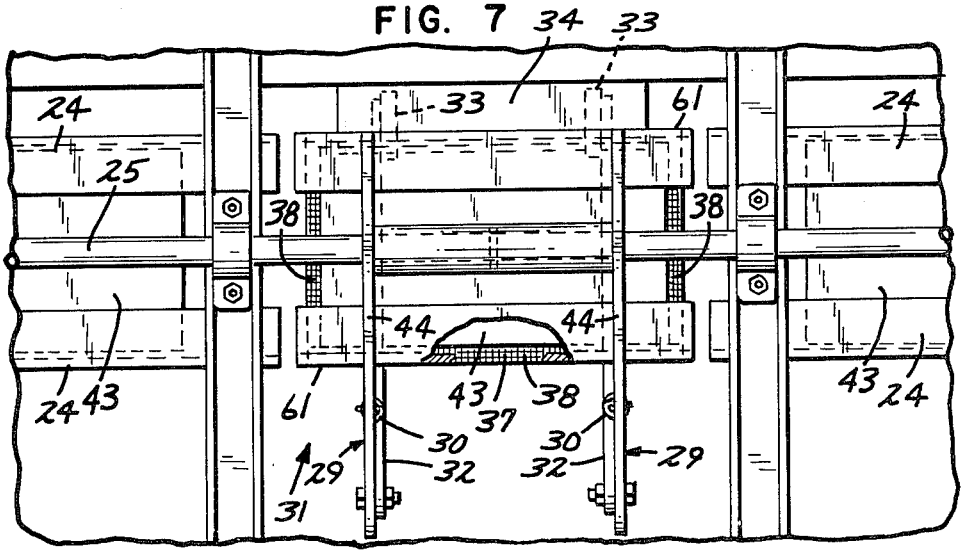
FIG. 7, is a bottom plan view of the present invention as shown in FIG. 2, taken generally along the lines 7—7.
Figure 6:
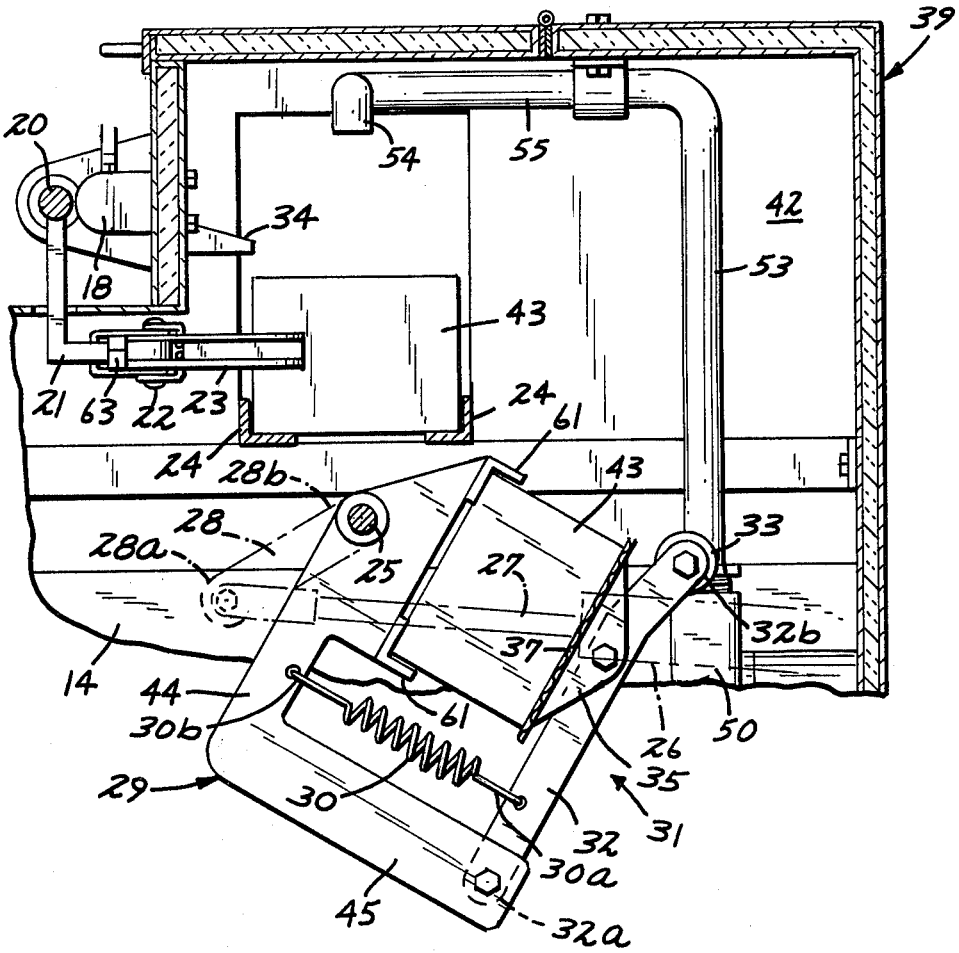
FIG. 6 is an enlarged side view of a portion of the present invention as shown in FIG. 4, showing the tote box in a rotated position.

The cover holding member 35 has cooperatively connected to it a cover, that is a flat screen 37 having apertures 38. The apertures 38 are smaller than the contents of the tote box. As shown in FIG. 7, the screen 37 extends beyond the sides of the tote box 43. As shown in FIG. 6, the screen 37 is positioned across the open top of the tote box 43.

Located above the reservoirs 11, 12, and 13 are means for rotating the tote box 43. The tote box 43 is supported by a tote box support member 29. A shaft 25 is cooperatively connected to the tote box support member 29. A connecting arm 28 having a first end **28*a* is connected to an air cylinder rod 27 of an air cylinder 26. A second end 28*b* of the connecting arm 28 is cooperatively connected to the shaft 25. The connector arm 28 is generally perpendicular to a longitudinal axis of the shaft 25. When the air cylinder rod 27 is actuated by the air cylinder 26, the connecting arm 28 rotates about the shaft 25, causing the shaft 25 and tote box support member 29 to rotate. It is understood that other suitable rotating mechanisms, such as a motor, may be used. Instead of having one rotating means that rotates all of the cover engaging mechanisms 31** simultaneously, each cover engaging mechanism may have a seperate rotating means.

A pump 50 is located proximate to the wash tank reservoir 12. In communication with the pump 50 is an inlet pipe 51, positioned inside the wash tank reservoir 12 and below the washing solution line 52, and an outlet pipe 53, cooperatively connected to outlet heads 54 by means of a transfer pipe 55.

Similarly, a pump 56 is located proximate to the rinse tank reservoir 13. In communication with the pump 56 is an inlet pipe 57 positioned below the rinsing solution line 58, and outlet pipe 59 cooperatively connected to outlet head 60.

Figure 8:
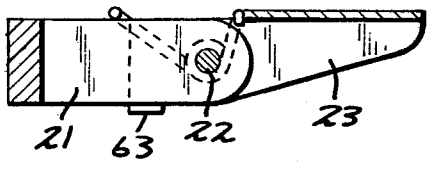
FIG. 8 is a cross-sectional view of the present invention as shown in FIG. 4, taken generally along the lines 8—8.
Figure 3:
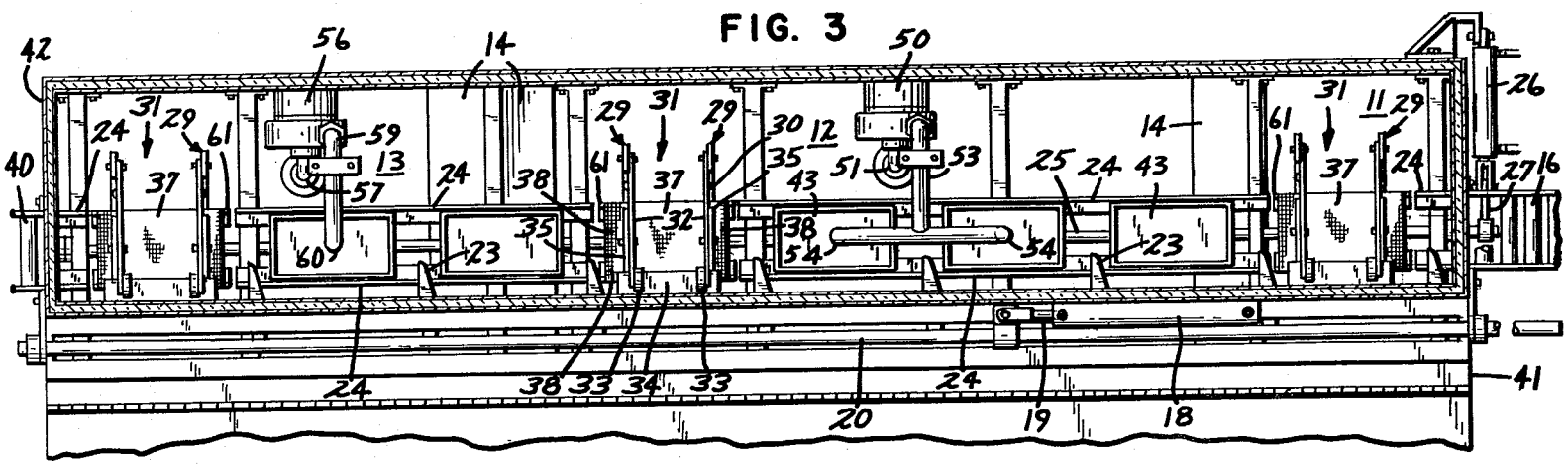
FIG. 3 is a top plan view of the present invention as shown in FIG. 2, taken generally along the lines 3—3.
Figure 5:
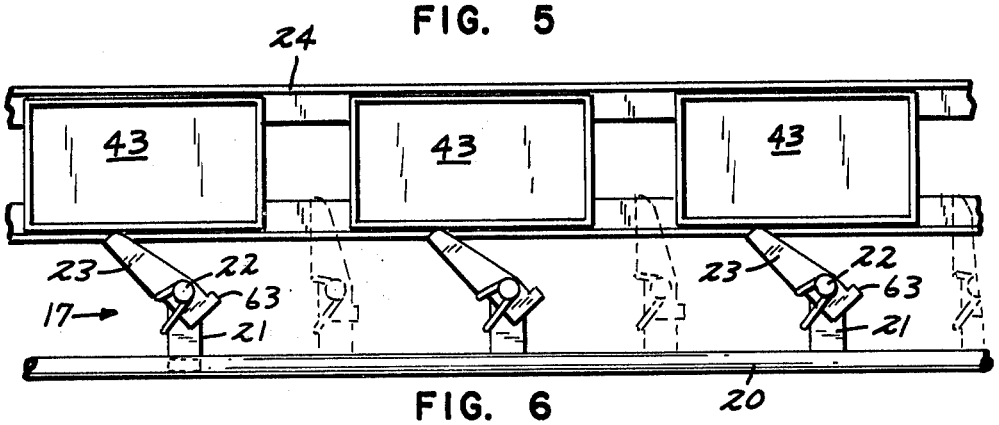
FIG. 5 is a top plan view of the present invention as shown as FIG. 1, taken generally along the lines 5—5.

As shown in FIG. 5, in a preferred embodiment, the tote boxes 43 are transported through the tote box parts washer 10 on a walking beam conveyor, generally designated at 17. The walking beam conveyor 17 includes a pair of generally parallel guide tracks 24 for supporting the tote boxes 43. As shown in FIGS. 3 and 7, the guide tracks 24 are discontinuous under the cover holders 35. The first portion 44 of the tote box support member 29 has formed therein two parallel channel members 61. The channel members 61 provide a guide for the tote boxes 43, similar to the guide tracks 24. A plurality of pushing arms 23 are pivotally connected to a bar 20. The bar 20 is generally parallel to the guide tracks 24. The pushing arm 23 is positioned above the guide tracks 24. Typically, the pushing arm 23 is pivotally pinned to a boss 21 by means of a pin 22. The boss 21 is cooperatively connected to the bar 20. One end of the bar 20 is connected to the air cylinder rod 19 of air cylinder 18. When the air cylinder 18 is actuated, the air cylinder rod 19 moves the bar 20 to its extended position. The pressure arms 23 contact the tote box 43 and index the tote boxes 43 forward. As the bar 20 is retracted, the pressure arms 23 contact the tote boxes 43, pivot, and then return without indexing the tote boxes 43 backward. A spring 62 biases the pressure arms 23 in a position generally parallel to the boss 21 to index the tote boxes 43 forward again. As shown in FIG. 8, a stop 63 prevents the pushing arm 23 from being biased beyond a position generally parallel to the boss 21. It is understood that other suitable transporting and indexing may be used.

Drain pans 14 are fastened to reservoirs 12 and 13 and prevent the solutions that overflow from the tote boxes 43 from splashing into the adjacent reservoir.

In operation, tote boxes 43 arrive at the tote box part washer 10 on the loading conveyor 16. The tote boxes 43 are then fed manually or by means of a stop-batch and feed mechanism (not shown) onto the guide tracks 24 of the walking beam conveyor 17. The walking beam conveyor 17, then indexes the tote boxes 43 through the tote box part washer 10.

The tote box 43 is moved from the loading conveyor 16 to the oil dumping stage. The tote box 43 moves onto the guide tracks 24 and then onto the channel members 61 of the tote box support member 29. The tote box 43 is in an upright horizontal position, so that the contents of the tote box 43 are not emptied out of the open top. Air cylinder 26 is actuated, wherein air cylinder rod 27 is extended to the position shown in phantom in FIG. 6. This in turn causes the connector arm 28 and shaft 25 to rotate. As the shaft 25 begins to rotate, the tote box support member 29 is also caused to rotate. As the tote box support member 29 rotates in a clockwise direction, as viewed in FIG. 4, the connector arm 32 moves to the right. As the connector arm 32 moves to the right, the roller 33 leaves the support 34. The spring 30 then biases the cover holder 35, holding the screen 37, against the open top of the tote box 43. The cover engaging mechanism 31 then continues to rotate to an unload position, as shown in FIG. 6. The rotation is greater than 90 degrees so that any fluids that accumlated in the bottom of the tote box during the processing of the parts drain to the oil tank reservoir 11. The screen 37 is flat and retains the contents of the tote box inside the tote box 43. Although it is possible, there is no need, to rotate the tote box 43 a full 180° to empty any solution from the tote box. In a preferred embodiment, the rotation is between 91° and 120°. The tote box 43 and the tote box support member 29 are then caused to rotate to their original position when the air cylinder rod 27 is retracted. As the cover engaging mechanism 31 returns to its original position, the roller 33 engages the supporting surface 34 and overcomes the force of the spring 30, causing the cover holder 35 to separate from the open top of the tote box 43.

Next the walking beam conveyor 17 is actuated, indexing the tote box 43 to its next position, which is the first position in the washing stage. As shown in FIG. 2, the next station is a dead space station, that is, no action to the tote box or parts occurs.

The walking beam conveyor 17 is then actuated again, and the tote box 43 is advanced to the next station. The tote box 43 remains horizontal and the pump 50 is activated. Washing solution from the wash tank reservoir 12 is pumped into inlet pipe 51, through outlet pipe 53, transfer pipe 55 and finally out the outlet heads 54. The volume pumped is twice the volume of the tote box 43, and preferably at least three to four times the volume of the tote box, thereby causing the solution to overflow from the tote box 43. The washing solution floods the tote box 43 and the contents thereof, filling the tote box 43. The washing solution that overflows carries with it dirt and remaining oil.

The walking beam conveyor 17 is then actuated indexing the tote box 43 to the second washing station. The second washing station is identical to the first washing station. Typically, but not exclusively, the tote box 43 would be indexed every one minute. Therefore, in a preferred embodiment, as shown in FIG. 2, the tote box part washer 10 has two one minute washing cycles. It is understood, that it would be possible to add a third washing station to obtain three one minute washing cycles. It can readily be seen that the tote box washer 10 may have any number of wash stations.

The walking beam conveyor 17 is then actuated, indexing the tote box 43 to the channel member 61 of a tote box support member 29. Then, similar to the previously described oil dumping stage, air cylinder 26 is actuated, extending the air cylinder rod 27, causing the shaft 25 and tote box support member 29 to rotate in a clockwise direction. Here, as in the oil dump stage, a screened cover 37 is clamped to the open top of the tote box 43 and the tote box is rotated more than 90 degrees to empty the washing solution from the tote box 43.

The walking beam conveyor 17 is then actuated, indexing the tote box 43 to a dead space station, where no action is taken the tote box or tote box parts.

The walking beam conveyor 17 is then actuated, indexing the tote box 43 to the rinsing station of the rinsing stage. The tote box 43 is positioned under the outlet head 60. The pump 56 is actuated, causing a rinsing solution to enter inlet pipe 57, through outlet pipe 59 and out the outlet head 60. The volume pumped is several times the volume the tote box 43. The rinsing solution floods the tote box 43 and the contents thereof, filing the tote box 43. The rinsing solution that overflows further rinses the parts.

The tote box 43 is then indexed, by means of the walking beam conveyor 17, to the rinse dumping station. The operation here is identical to the operation at the oil dump station and the washing dump station. After the tote box 43 has been rotated more than 90 degrees to empty any rinsing solution in the tote box, is indexed to the unloading conveyor 40.

While the present invention has been described in terms of washing and rinsing the contents of the tote box, it is understood that the invention can also be used to perform a variety of processing functions. The flooding means can supply a variety of solutions to treat the parts at various processing stations, including solutions to seal, oil or prevent rust.

The tote box washer 10 is more energy efficient than a spray washer or methods of accomplishing washing a tote box and its contents. The tote box washer 10 is not as complex as other automatic washing systems and therefore have less maintenance expenses.

By keeping the contents of the tote box inside the tote box 43, there is no problem with the contents dropping out when the tote box 43 is rotated back to its upright horizontal position.

The other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the present invention which follows in the spirit and broad scope of the appended claims are included.

What is claimed is:

1. A method of cleaning contents of an open top tote box consisting essentially of:

(a) transporting the tote box to a first cleaning station;

(b) flooding the tote box while the tote box is horizontal with a cleaning solution at a first position at the first cleaning station, the cleaning solution having a volume at least twice that of the tote box, whereby the cleaning solution will flow over the open top of the tote box;

(c) indexing the tote box to a second position at the first cleaning station and flooding the tote box while the tote box is horizontal with a cleaning solution, the cleaning solution having a volume at least twice that of the tote box, whereby the cleaning solution will flow over the open top of the tote box;

(d) indexing the tote box to a third position at the first cleaning station and covering the open top of the tote box with a cover having apertures smaller than the contents of the tote box;

(e) rotating the tote box less than 180° to empty any solution in the tote box through the cover, the contents of the tote box being retained in the tote box by said cover; and (f) removing the cover and transporting the tote box from the first cleaning station;

2. The method of claim 1, further comprising the intitial step of:

(a) transporting the tote box to a dumping station;

(b) covering the open top of the tote box with a cover having apertures smaller than the contents of the tote box;

(c) rotating the tote box less than 180° to empty any fluids that may be in the tote box, the contents of the tote box being retained in the tote box by said cover; and (d) removing the cover and transporting the tote box to a first cleaning station.

3. The method of claim 1, further comprising the additional steps of:

(a) transporting the tote box to a rinsing station;

(b) flooding the tote box with a rinsing solution;

(c) covering the open top of the tote box with a cover having apertures smaller than the contents of the tote box;

(d) rotating the tote box less than 180° to empty any solution in the tote box through the cover, the contents of the tote box being retained in the tote box by said cover; and (e) removing the cover and transporting the tote box from the rinsing station.

4. The method of claim 1, 2, or 3, wherein the rotation of the tote box is between 91 degrees to 120 degrees.

* * * * *